US010890016B2

(12) United States Patent
Brewer

(10) Patent No.: US 10,890,016 B2
(45) Date of Patent: Jan. 12, 2021

(54) SLIDING ENTRY DOOR WITH INTEGRATED VENT AND LATCH

(71) Applicant: ProVia Holdings, Inc., Sugarcreek, OH (US)

(72) Inventor: Thomas Brewer, Sugarcreek, OH (US)

(73) Assignee: ProVia Holdings, Inc., Sugarcreek, OH (US)

( * ) Notice: Subject to any disclaimer, the term of this patent is extended or adjusted under 35 U.S.C. 154(b) by 105 days.

(21) Appl. No.: 15/982,603

(22) Filed: May 17, 2018

(65) Prior Publication Data

US 2018/0334833 A1 Nov. 22, 2018

Related U.S. Application Data

(60) Provisional application No. 62/507,259, filed on May 17, 2017.

(51) Int. Cl.

| | |
|---|---|
| ***E05F 11/02*** | (2006.01) |
| ***E05B 65/08*** | (2006.01) |
| ***E05C 9/22*** | (2006.01) |
| ***E05C 17/62*** | (2006.01) |
| *E05C 9/18* | (2006.01) |

(52) U.S. Cl.

CPC ..... *E05B 65/0823* (2013.01); *E05B 65/0876* (2013.01); *E05C 9/22* (2013.01); *E05C 17/62* (2013.01); *E05C 9/1858* (2013.01); *E05C 9/1875* (2013.01)

(58) Field of Classification Search

CPC .... E05B 65/0829; E05B 65/0823; E05C 9/22; E05C 17/62; E05C 9/1858; E05C 9/1875; E05C 9/12; E05C 1/08; Y10T 292/108; Y10T 292/0843; Y10T 292/1018; Y10T 292/1075; Y10T 292/089; Y10T 292/1076; Y10T 292/1079

USPC ..... 49/291, 394, 221, 185, 209, 395, 235, 49/425; 292/35, 32, 33, 34, 40, 39, 66, 292/142, DIG. 46, DIG. 31

See application file for complete search history.

(56) References Cited

U.S. PATENT DOCUMENTS

| | | | | |
|---|---|---|---|---|
| 3,670,455 | A * | 6/1972 | Slaybaugh | E05F 15/635 49/360 |
| 6,782,661 | B2 | 8/2004 | Manzella | |
| 7,421,868 | B2 * | 9/2008 | Matyko | E05C 9/042 292/39 |
| 7,607,262 | B2 * | 10/2009 | Pettit | E05B 5/003 49/185 |
| 7,971,392 | B2 | 7/2011 | Seo | |
| 8,020,904 | B2 * | 9/2011 | Flory | E05B 63/14 292/241 |

(Continued)

*Primary Examiner* — Chi Q Nguyen

(74) *Attorney, Agent, or Firm* — McDonald Hopkins LLC

(57) ABSTRACT

A lockable sliding door is described. A ratcheted track allows the movable panel of the door to be selectively locked in both closed and vented positions. A lever is positioned along a midpoint of the movable panel to allow for the easy engagement of the locking mechanism. Further, the locking mechanism is carried on the movable panel. The technology is configured to allow the sliding door to be locked in various configurations, with the door partially opened, completely open, or completely closed. The technology may also be utilized on windows or any other architectural features with a slide-to-open and close design.

16 Claims, 5 Drawing Sheets

(56) References Cited

U.S. PATENT DOCUMENTS

| | | | | |
|---|---|---|---|---|
| 8,181,393 | B2 * | 5/2012 | Talpe | E05B 65/1006 292/142 |
| 8,899,635 | B2 | 12/2014 | Nakanishi | |
| 10,392,839 | B2 * | 8/2019 | Wolf | E05C 9/041 |
| 2010/0132262 | A1 * | 6/2010 | Talpe | E05B 65/1006 49/394 |
| 2010/0218568 | A1 * | 9/2010 | Nakanishi | E05B 63/0056 70/91 |
| 2015/0052817 | A1 * | 2/2015 | Bourgoin | E05D 15/04 49/394 |
| 2016/0251885 | A1 * | 9/2016 | Conley | E06B 3/924 49/127 |
| 2017/0058579 | A1 * | 3/2017 | Wolf | E05C 9/046 |

* cited by examiner

SLIDING ENTRY DOOR WITH INTEGRATED VENT AND LATCH

CROSS-REFERENCE TO RELATED APPLICATION

The application claims the benefit of U.S. Provisional Patent Application No. 62/507,259, entitled "SLIDING ENTRY DOOR WITH INTEGRATED VENT AND LATCH," filed on May 17, 2017, which is hereby incorporated in its entirety by reference.

TECHNICAL FIELD

The present invention relates generally to an entry door and, more specifically, to a sliding entry door having a latching mechanism operable from a midpoint of the door itself which also secures the door in a partially opened, vent position.

BACKGROUND

Sliding doors are common points of entry in many homes and buildings. Generally speaking, these doors consist of at least one stationary panel and at least one movable panel, all of which are confined within a main frame assembly. The stationary panel may be fixed within the frame, while movable panel slides along a defined track along an inner facing portion of the frame. Both the stationary and movable panels may have subframe assemblies to accommodate transparent or translucent materials. These subframe assemblies serve both decorative and structural purposes.

Given that sliding doors are points of entry, locking mechanisms are usually integrated in a manner that prevents the movable panel from moving within its track when the lock is engaged. Most sliding doors rely on a latch or other lockable actuator that engages or is carried in or on an edge of the movable panel. In particular, the actuator is securely fixed. The user then slides or rotates the actuator to be received by, and in some cases engage with additional locking features in, an aperture. This aperture is formed along the main frame or an equivalent structure positioned adjacent to the door, although some arrangements may have the aperture formed in the panel with the actuator associated with the frame. In either case, the engagement of the actuator and aperture prevents the door from moving unless/until the actuator is disengaged.

It may sometimes be desirable to position the door in a partially open position to allow for airflow from the outside. Both for security and to ensure the door does not accidentally slide closed, lock mechanisms have been designed accommodate both fully closed and vented (i.e., partially open) positions. One arrangement for locking the door in both of these positions contemplates a second aperture. This second aperture is spaced apart from the first aperture within the frame to restrict movement of the movable panel when it is in its vented position. The use of dual apertures requires the actuator-apertures combination to be positioned along the top or bottom facing of the main frame, which often results in the locking mechanism being in a relatively inconvenient and difficult to access position relative to the door handle.

An illustration of one device according to the prior art is shown in FIG. 15. A spring-loaded plunger 10 is shown in an open position, although it may be repeatedly depressed to toggle between locked (i.e., down) and open (i.e., up) positions. Generally speaking, plunger 10 is attached by fasteners to the bottom edge of the movable panel 20 along its subframe 22. An engagement plate 30 is attached by fasteners to an edge rail on door main frame 40. The plate 30 includes a vent aperture 32 and a closed/locked aperture 34 spaced apart from one another. The device is installed when the spring-loaded plunger is in a closed/locked position, with the plunger 20 and plate 30 being attached so that the actuator bolt 12 penetrates the closed/lock aperture 34. When the plunger is open, the door moves freely, thereby allowing it to be repositioned so that bolt 12 can penetrate the vent aperture in order to lock the door in a partially open, vent position.

U.S. Pat. No. 8,899,635 discloses a multi-point lock assembly for sliding doors. Shoot bolts are urged into place by a drive assembly in conjunction with an extension bar into which customized apertures can be cut. The arrangement allows the lock assembly to be fitted to doors of varying heights.

U.S. Pat. No. 7,971,392 describes a roller unit for lift-up sliding doors and windows. The unit is actuated by a rotating handle to effect vertical movement in the door relative to the frame.

A need exists for a simple, multi-position lock mechanism that can be operated from a control at or near the same elevation as the door handle itself. Similarly, a lock mechanism that accommodates a plurality of vent positions would be welcome.

SUMMARY

A sliding entry door can be secured in both fully closed and partially open, vented positions. An engagement mechanism is attached to the main frame of the sliding door. An actuator, such as a lever, is provided along the sub frame of the movable panel, to lock the door in place. The engagement mechanism may include series of teeth to allow the door to be secured along any number of partially open positions, as well as in a fully closed and locked position.

The door, lock, and latch mechanisms according to various aspects described herein may include any one of the following features (also as described in more detail below).

In an embodiment, the technology discloses a sliding door assembly having a frame having at least one inward facing track and a movable panel cooperating with the inward facing track to allow the panel to move between closed and open positions. The assembly also includes an actuator mechanism carried on the movable panel and an engagement mechanism including a ratcheted rack with a plurality of teeth and attached to the inward facing track. When the actuator mechanism cooperates with the engagement mechanism, the assembly may selectively lock the movable panel in a partially open position.

In an embodiment, the technology also discloses a sliding door lock system having an actuator mechanism configured to be carried on a movable panel and an engagement mechanism including a ratcheted rack with a plurality of teeth configured to be attached to an inward facing track of the movable panel. When the actuator mechanism cooperates with the engagement mechanism, the moveable panel may be selectively locked.

In an embodiment, the technology also discloses a sliding window assembly including a frame having at least one inward facing track and a movable panel cooperating with the inward facing track to allow the panel to move between closed and open positions. The technology also includes an actuator mechanism carried on the movable panel and an engagement mechanism including a ratcheted rack with a plurality of teeth and attached to the inward facing track. When the actuator mechanism cooperates with the engagement mechanism, the moveable panel may be selectively locked in a partially open position.

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

BRIEF DESCRIPTION OF THE DRAWINGS

Operation of the invention may be better understood by reference to the detailed description taken in connection with the following illustrations. These appended drawings form part of this specification, and any written information in the drawings should be treated as part of this disclosure. In the same manner, the relative positioning and relationship of the components as shown in these drawings, as well as their function, shape, dimensions, and appearance, may all further inform certain aspects of the invention as if fully rewritten herein. All sectional views noted herein are taken from the vantage point indicated by the arrows defining the view in question. In the drawings.

DETAILED DESCRIPTION

Figure 1:
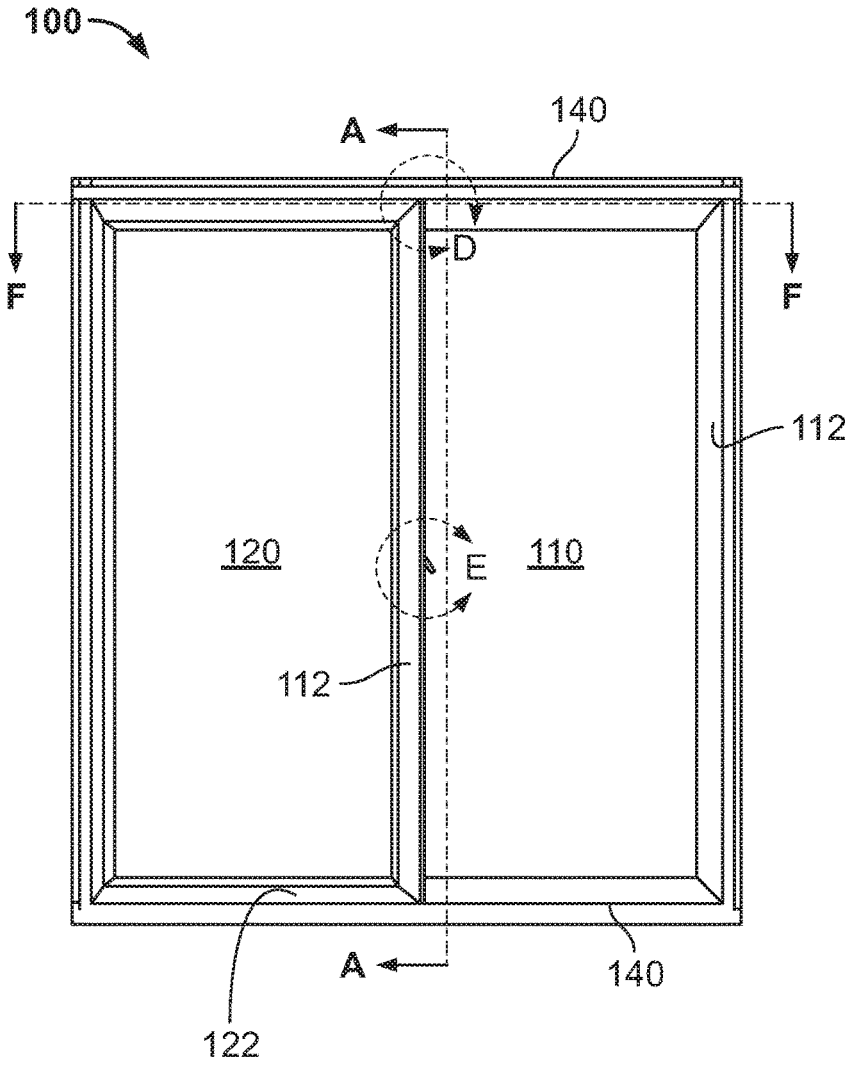
FIG. 1 is an anterior view of the door assembly according to certain aspects disclosed herein.
Figure 2:
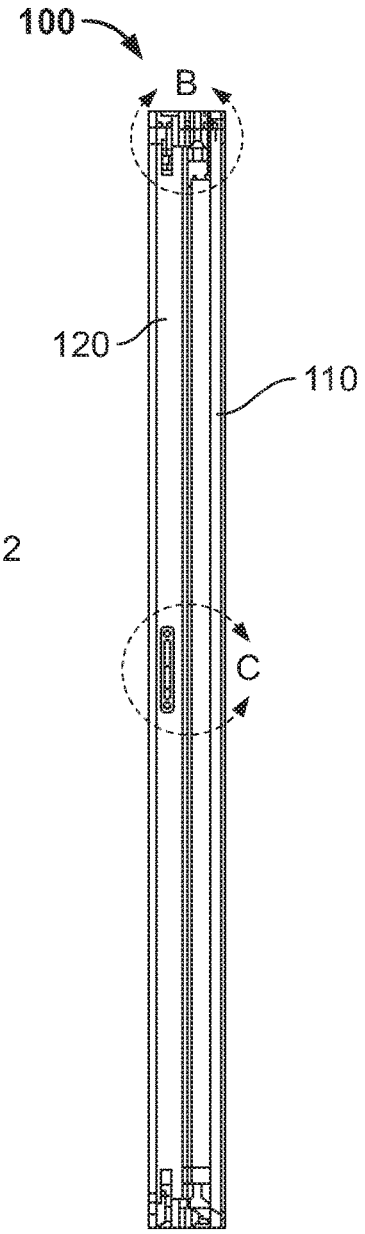
FIG. 2 is a sectional lateral view taken along the line A-A in FIG. 1.
Figure 4:
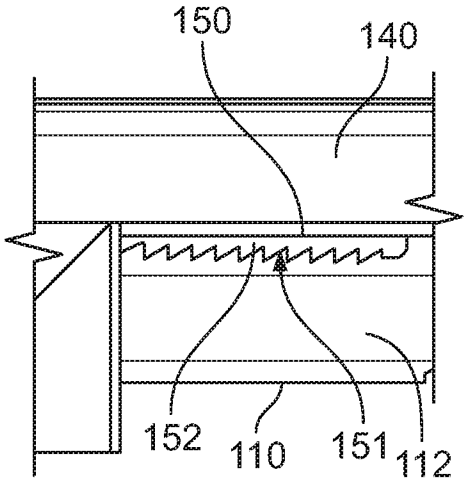
FIG. 4 is a sectional anterior view taken from the inset defined by arc D in FIG. 1.
Figure 3B:
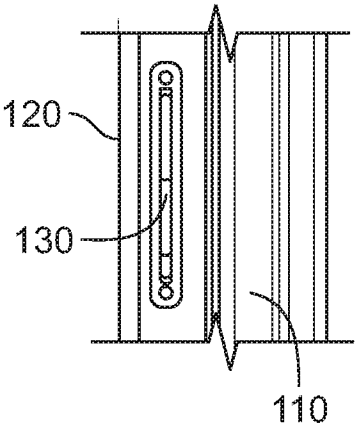
FIG. 3B is a sectional lateral view taken from the inset defined by arc C in FIG. 2.
Figure 3A:
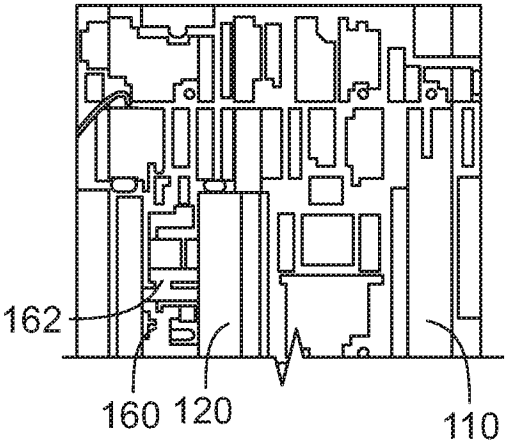
FIG. 3A is a sectional lateral view taken from the inset defined by arc B in FIG. 2
Figure 6:
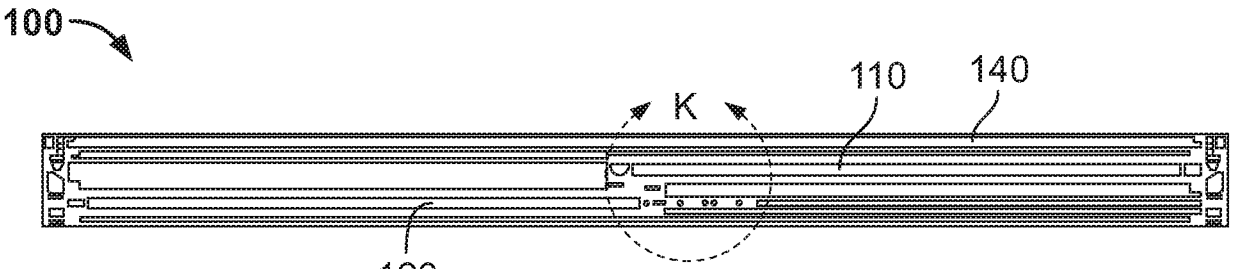
FIG. 6 is a top view taken along the line F-F in FIG. 1.

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Generally speaking, a sliding entry door having an elevated latch is contemplated. The latch is elevated in the sense that it is positioned closer to the height of the door handle, rather than being positioned proximate to the top or bottom of the door itself. The latch is carried on the movable panel of the door. Along a top edge of the frame, an engagement assembly provides a plurality of contact points that engage an actuator carried within the movable panel. The latch rotates or moves through a range of motion to urge the actuator into a locked position.

Turning to FIGS. 1 through 13 (in which certain reference numerals may refer to common elements depicted in some of the various views shown in these figures), door assembly 100 includes a panel 110 that may be stationary relative to a movable panel 120 that incorporates certain aspects of the invention, as described herein. Specifically, panel 110 may be fixed in place, while panel 120 may slide freely along a defined lateral range of motion.

The assembly 100 itself is also bounded on its outer periphery by main frame 140, which may include tracks 165, slides, rollers, or other mechanisms to facilitate the movement and sliding motion of the panel 120. In some embodiments, the panels 110, 120 are encased by the frame 140 to prevent the panels from being removed or dislodged. Generally speaking, the panels 110, 120 are offset and/or slide independently in separate tracks, e.g., inward facing track 165, to allow the movable panel 120 to substantially overlap with the fixed panel 110 to provide the greatest possible clearance when the door assembly 100 is slid open.

Each panel 110, 120 may respectively include subframes 112, 122 for structural purposes and/or to retain other elements of the door/panel (e.g., glass or composite windows, one or more skins, etc.). In particular, the subframes 112, 122 may be fixed to the frame 140 and/or engage the tracks, slides, etc. within the frame's inner facing surfaces, particularly along the bottom inner edge and/or the top inner edge. The subframes 112, 122 may be made of any appropriate material, including, but not limited to metal, plastic, wood or a combination or two or more thereof. Further, a conventional (but optional) lock may be disposed within the vertically rising sides of the subframe(s) 112, 122 to secure the door in its closed position. The lock may be made of any appropriate material, including, but not limited to metal or plastic or a combination or two or more materials. Finally, the subframes 112, 122 may also support one or more insulating layers.

Figure 5:
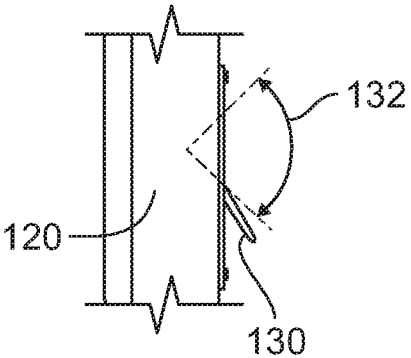
FIG. 5 is a sectional anterior view taken from the inset defined by arc E in FIG. 1.
Figure 7:
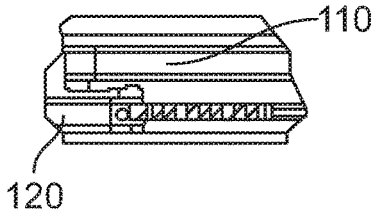
FIG. 7 is a sectional top view taken along the inset defined by the arc K in FIG. 6.
Figure 8:
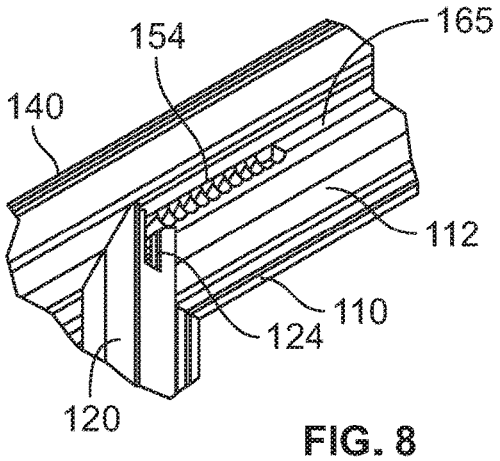
FIG. 8 is a perspective view of the engagement assembly depicting the area also illustrated in FIGS. 4 and 7.
Figure 9A:
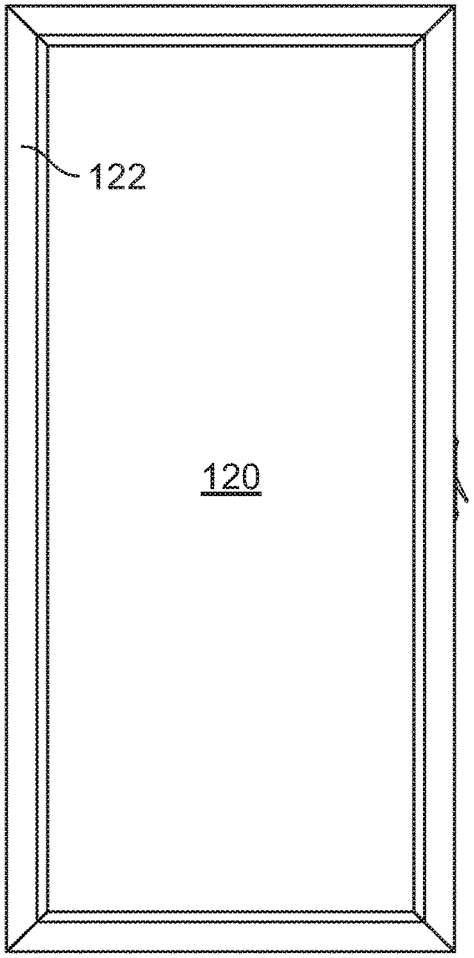
FIG. 9A is an anterior view and FIG. 9B a lateral view of the movable panel according to certain aspects disclosed herein.
Figure 9B:
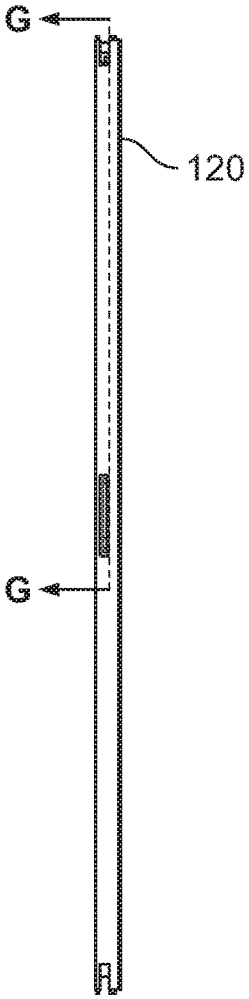
Figure 10:
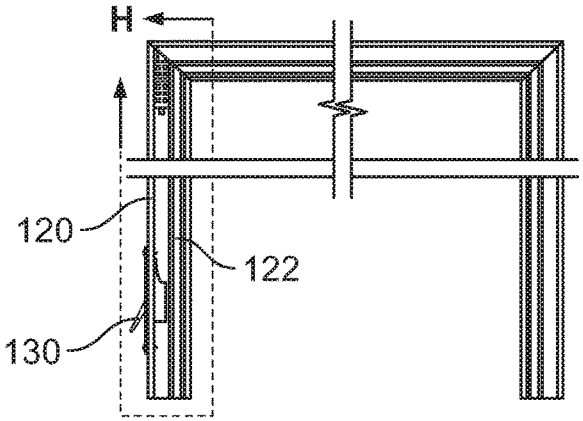
FIG. 10 is a sectional anterior view taken along the line G-G in FIG. 9B.
Figure 11:
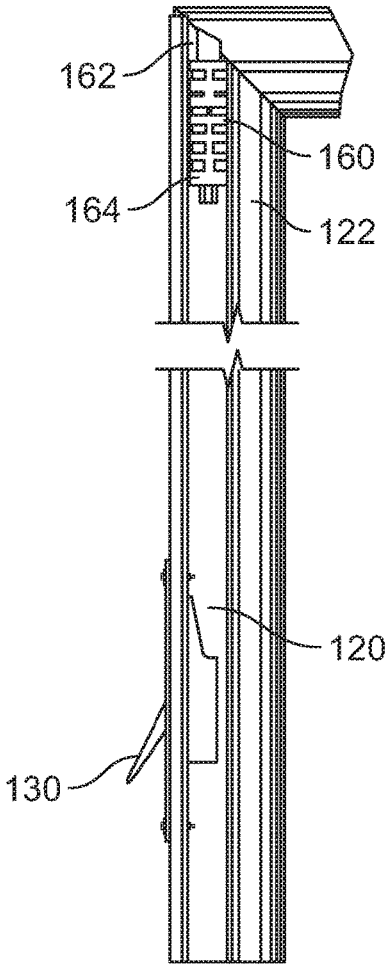
FIG. 11 is a sectional anterior view in partial cutaway taken from the inset defined by the arc H in FIG. 10.
Figure 12:
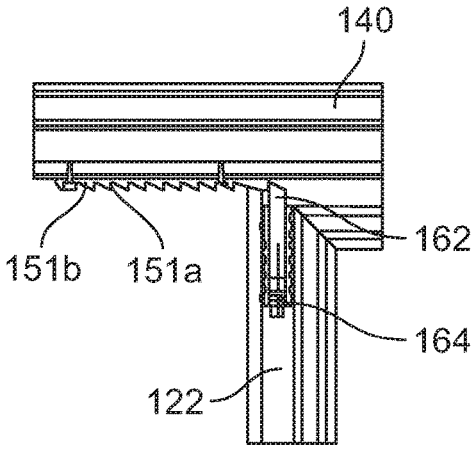
FIG. 12 is a sectional anterior view in partial cutaway of the engagement assembly depicting the area illustrated in FIGS. 4, 7, and 8.
Figure 13:
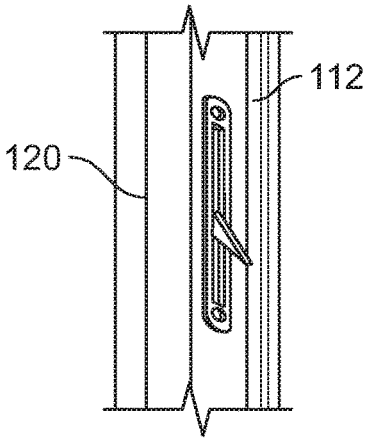
FIG. 13 is sectional lateral view of the latch mechanism illustrated in FIG. 11.
Figure 14:
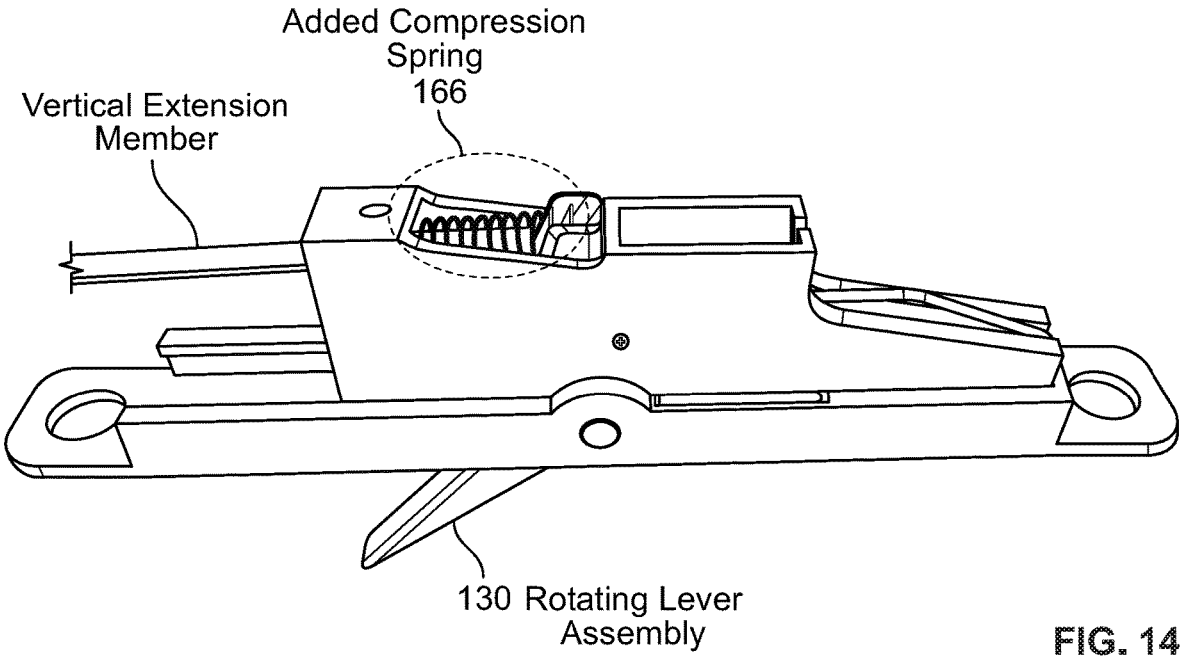
FIG. 14 is a side view of the engagement mechanism.

A rotating lever, knob, or other control 130 is provided along the vertical rising side of the subframe 122, may be at or near its midpoint, i.e., corresponding to the elevation of the door handle (not shown), anywhere between 28 inches (~71 centimeters) and 48 inches (~122 centimeters) above the ground and/or bottom of frame 140. Lever 130 may rotate within a plane that is generally orthogonal to the ground and, more specifically, generally parallel to the anterior surface defined by the panel 122. The rotating lever 130 may be made of any appropriate material, including, but not limited to metal, plastic, wood or a combination or two or more thereof. With reference to FIG. 5, angle 132 indicates a potential range of about 170°, as this spacing provides sufficient force through the movement of the lever to cooperate with the engagement assembly 150, as will be described below. The range of the angle is not limited to any particular range except as limited by the moveable panel 120 but rather may be any appropriate angle that allows the rotating lever to function as required.

In one aspect, lever 130 attaches to a vertical extension member that is connected to an actuator 160. Actuator 160 is urged upward to engage the assembly 150 and, more specifically, to fit bolt 162 in one of the detents 151 defined by teeth 152 in a ratcheted rack assembly 154 attached to a top inner facing of the frame 140. The rack 154 may be made of any appropriate material, including, but not limited to metal or plastic or a combination or two or more materials. The actuator 160 and bolt 162 may be made of any appropriate material, including, but not limited to metal or plastic or a combination or two or more materials. Additionally, the detents 151 and related teeth 152 may be made of any appropriate material, including, but not limited to metal or plastic or a combination or two or more materials. Thus, when the lever 150 is moved downward, the vertical member associated with the actuator 160 urges the bolt 162 upward to lock the actuator 160 in place relative to the frame 140 (and by extension, the entire panel 120). A biasing member or members may be incorporated within the housing 164 of the actuator 160 to facilitate this upward locking motion.

In an embodiment, the rotating lever 130 may include a biasing member 166 to limit the amount of retraction force that may be applied to the bolt 162. In an embodiment, the biasing member 166 may be load level compressing spring, but any appropriate biasing member that can limit the force applied to the bolt 162 may be incorporated. The biasing member 166 may allow users to compensate for uncontrolled sizing and location of components of the door assembly system. Further, the biasing member 166 may allow for overtravel of the rotating level 130 without overloading and disconnection of the vertical extension member.

In one aspect, the detents 151 are further characterized by a "zig-zag" or ratcheted profile. That is, the detents 151 form acute angles in which one side 151*a* is effectively vertical (i.e., orthogonal to the frame 140 and/or ground), while the opposing side 151*b* of the detent is sloped. This pattern is repeated along however many teeth 152 may be incorporated into rack assembly 154. In this manner, the bolt 162 will be urged into the deepest part of the detent. Vertical side 151*a* sufficiently engages the bolt 162 to prevent lateral movement unless and until the actuator is retracted by moving the lever 150 upward (thereby pulling the actuator 160 downward by its attachment via the vertical member connected these elements). However, provided the slope of side 151*b* is sufficiently gradual in comparison to the spring force created by the biasing member of actuator 160, it may be possible to move (and, therefore, slide the entire panel) in the opposing direction.

By positioning the rack 154 appropriately, the teeth 152 (and, more specifically, the vertical sides 151*a*) define locking positions for the door. The edge of the rack 154 closest to the point where the panel 120 comes into contact with the frame 140 along its vertically rising edge may serve as a lock for the door assembly 100 in its closed positions. The vertical sides 151*a* adjacent to this lock position create additional locking positions in which the door is immobilized in partially open, vent positions. Further, the cooperating action of the biased actuator 160 in combination with the sloped sides 151*b* allow for the door to be selectively slid in one direction. That is, the sloped sides 151*b* permit the spring to be forced to retract (thereby allowing for the panel 120 to slide in that direction) if sufficient lateral force is exerted on the panel 120. However, the vertical side 151*a* will prevent the panel 120 from being slid in the opposing direction. In this manner, the vent positions of door assembly 100 can be locked.

The bolt 162 may have a sloping profile to better engage and cooperate with the teeth 152. Bolt 162 should also be of sufficiently sturdy construction (relative to materials, as well as its attachment to panel 120 and/or subframe 122) to serve as a lock mechanism. Bolt 162 may be carried within the housing 164 in order to simplify construction. One or more springs help to orient the bolt 162 within the housing, in addition to providing sufficient spring force to accomplish the venting and locking aspects described herein.

Once the door is slid beyond the point at which the actuator 160 is proximate to the engagement mechanism 150, the bolt 162 simply floats in place and the panel 120 behaves as would any such panel without the lock-vent disclosed herein. A trailing edge slope can be incorporated at the far end (i.e., opposite the closed/locked position/where the panel is open) of the rack to provide a tactile cue (via the increased resistance/friction as the biasing action of actuator 160 is entered on that trailing edge slope) to someone sliding the door open that the locking mechanism will be engaged. In some aspects, the entire length of the slide or track on the main frame 140 can incorporate a ratcheted rack 154, so as to provide the selective locking provided by the assembly 100. Certain components, including the biasing member, actuator, teeth, and/or lever, can be engineered to provide additional audible and/or tactile cues with respect to operation of the lock.

While the sloping sides 151*b* are all shown to have the same orientation, it may be possible to vary or alternate their presentation to allow for different movement and locking positions. In the same manner, by reversing the direction of the slope, the door could be allowed to slide in the opposite direction (e.g., rather than restricting the panel to be opened without engaging the lever 130, it could instead be arranged to prevent the door from closing). It may also be possible to eliminate the vertical sides 151*a* in the rack 154 and, instead, rely on the assembly 100 to merely restrict movement of the panels in either direction when sufficient lateral force is applied (as one example, this "non-locking" aspect of the assembly 100 could find utility in door installments such as on boats where frequent motion may cause sliding doors to move).

Figure 15:
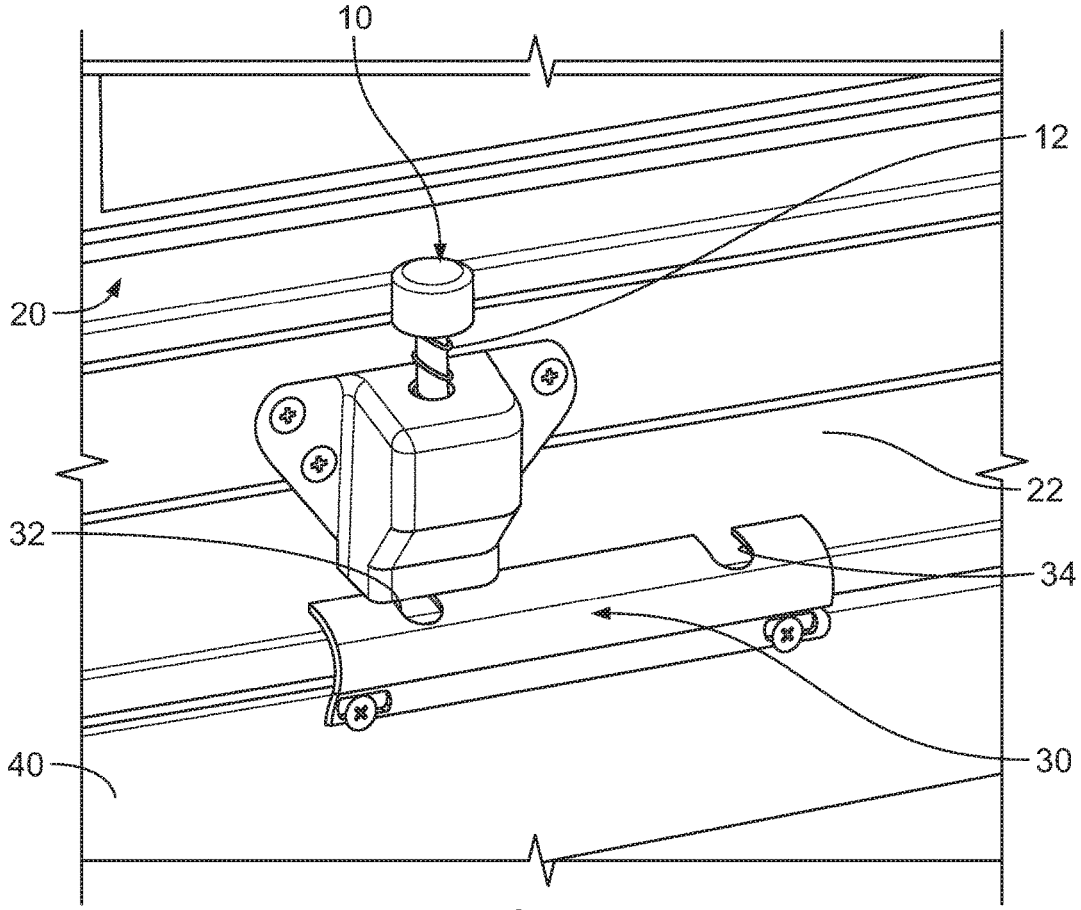
FIG. 15 is a perspective view of a vent lock mechanism according to the prior art.

In one aspect, rack 154 is fitted within a channel or recess 124 along the top of the door. This arrangement minimizes the visible profile of the engagement assembly 150 while also allowing the panel 120 to enabling waterproof and airtight seals. Indeed, the entire assembly 100 can be incorporated within familiar panel and door designs with minimal impact on the aesthetics, and particularly in comparison to prior art systems like the one shown in FIG. 15.

While the engagement assembly 150 and actuator 160 are shown as being positioned along the top edge of the panel 120, it is possible to orient these elements at the bottom edge of the panel 120 instead. Further, for added security, it would be possible to design an assembly with a plurality of engagement assemblies 150 and actuators 160 at both the top and bottom edges of the panel 120.

In an embodiment (not shown), the technology may be used in a window setting to secure a moveable window panel against a window frame and prevent further vertical movement. In such an embodiment, the rotating lever may be provided along a horizontal side of a frame and the actuator and engagement assemblies may be positioned along a side of the moveable window panel. The other components of the technology of a sliding window assembly are similar to those of the sliding door assembly. In the case of a horizontal or casement opening window, the configuration of the components may be more closely related to those of the sliding door assembly.

As noted above, other mechanisms are contemplated that may not need to rotate through this precise range of motion. As one non-limiting example, a twist knob, button, or push/pull tab could translate its moving action through internal gears or springs in order to provide the necessary force to cooperate with the engagement mechanism 150 (as will be described in greater detail below), such as through the use of teeth or splines on the vertical member cooperating with gears or pinions associated with the knob/button/lever.

While a two panel door has been illustrated, it will be understood that additional movable and stationary panels could be incorporated. Further, the disclosure is not intended to be limited according to the configuration of the engagement assembly 150. Also, it will be appreciated that the mechanisms described herein can be incorporated in existing designs and/or retrofitted along an exterior edge to some existing doors. The nature of the materials throughout the door assembly and presence or absence of a subframe can be varied without impacting the utility of the aspects described herein. Finally, while the door assembly has been described as having both movable and stationary panels, it will be understood that the so-called stationary panel may, instead, duplicate the movable panel or otherwise be enabled to lock, vent, slide, swing, or otherwise move without departing from certain inventive aspects as disclosed herein.

Weatherstripping, gaskets, and other insulation mechanisms and techniques can be employed in the assembly. In the same manner, many of the construction materials and installation techniques common to existing sliding doors can be incorporated into this design with minimal—if any—alteration.

Although the present embodiments have been illustrated in the accompanying drawings and described in the foregoing detailed description, it is to be understood that the invention is not to be limited to just the embodiments disclosed. Numerous other rearrangements, modifications, alterations, and substitutions are also contemplated, all of which fall within the scope of the appended claims or the equivalents thereof.

What is claimed is:

1. A sliding door assembly comprising:

a frame having at least one inward facing track;

a movable panel cooperating with the inward facing track to allow the panel to move between closed and open positions;

an actuator mechanism carried on the movable panel, the actuator mechanism including a lever;

a ratcheted rack comprising a plurality of teeth, the ratcheted rack attached to the inward facing track; and wherein the actuator mechanism lockingly engages at least one of the teeth when the lever is rotated to a lever closed position and the actuator mechanism disengages the at least one of the teeth when the lever is moved to a lever open position.

2. The assembly of claim 1, wherein the actuator mechanism includes a biasing member.

3. The assembly of claim 1, wherein the teeth define at least one sloping side along a series of detents.

4. The assembly of claim 3, wherein the actuator mechanism includes a biasing member and the sloping side permits the movable panel to slide in a first lateral direction while preventing the movable panel from sliding in an opposite direction to the first lateral direction.

5. The assembly of claim 1, wherein the movable panel includes a channel to accommodate the lever as the movable panel slides along the inward facing track.

6. The assembly of claim 1, further comprising a second actuator mechanism carried on the movable panel;

a second ratcheted rack with a plurality of teeth, the second ratcheted rack attached to the inward facing track; and wherein the second actuator mechanism cooperates with the second ratcheted rack to selectively lock the movable panel in a partially open, vented position.

7. The assembly of claim 1, wherein the lever further comprises a lever biasing member.

8. The assembly of claim 1, wherein the engagement assembly and the actuator mechanism are positioned on a top edge of the moveable panel.

9. The assembly of claim 1, wherein the rack and actuator mechanism are positioned on a bottom edge of the moveable panel.

10. A sliding door lock system comprising:

an actuator mechanism configured to be carried on a movable panel, the actuator mechanism comprising a lever;

a ratcheted rack comprising a plurality of teeth, the ratcheted rack configured to be attached to an inward facing track of the movable panel; and wherein the actuator mechanism lockingly engages at least one of the teeth when the lever is rotated to a closed position and the actuator mechanism disengages the at least one of the teeth when the lever is moved to an open position.

11. The sliding door lock system of claim 10, wherein the actuator mechanism includes a biasing member.

12. The sliding door lock system of claim 10, wherein the teeth define at least one sloping side along a series of detents.

13. The sliding door lock system of claim 10, wherein the actuator mechanism includes a biasing member and the sloping side permits the movable panel to slide in a first lateral direction while preventing the movable panel from sliding in an opposite direction to the first lateral direction.

14. The sliding door lock system of claim 10, wherein the lever further comprises a biasing member.

15. A sliding window assembly comprising:

a frame having at least one inward facing track;

a movable panel cooperating with the inward facing track to allow the panel to move between closed and open positions;

an actuator mechanism carried on the movable panel, the actuator mechanism comprising a lever;

a ratcheted rack comprising a plurality of teeth, the ratcheted rack attached to the inward facing track; and wherein the actuator mechanism lockingly engages at least one of the teeth when the lever is rotated to a lever closed position and the actuator mechanism disengages the at least one teeth when the lever is moved to a lever open position.

16. The assembly of claim 15, wherein the actuator mechanism includes a biasing member and the sloping side permits the movable panel to slide in a first vertical direction while preventing the movable panel from sliding in an opposite direction to the first vertical direction.

* * * * *